US010604904B2

(12) United States Patent
Liu et al.

(10) Patent No.: US 10,604,904 B2
(45) Date of Patent: Mar. 31, 2020

(54) WATER CONSERVING GATE

(71) Applicant: Zhijun Wang, Shenzhen (CN)

(72) Inventors: Xiaojun Liu, Shenzhen (CN); Caixia Wang, Shenzhen (CN); Junlong Liu, Shenzhen (CN)

(73) Assignee: Zhijun Wang, Shenzhen (CN)

( * ) Notice: Subject to any disclaimer, the term of this patent is extended or adjusted under 35 U.S.C. 154(b) by 0 days.

(21) Appl. No.: 16/243,093

(22) Filed: Jan. 9, 2019

(65) Prior Publication Data

US 2019/0242085 A1 Aug. 8, 2019

(30) Foreign Application Priority Data

Feb. 8, 2018 (CN) ..... 2018 1 0130586

(51) Int. Cl.
*E02B 7/42* (2006.01)
*E02B 7/40* (2006.01)

(52) U.S. Cl.
CPC . *E02B 7/42* (2013.01); *E02B 7/40* (2013.01)

(58) Field of Classification Search
CPC ... E02B 7/44; E02B 3/102; E02B 7/20; E02B 7/40; E02B 5/082; E02B 7/42; E06B 2009/007
See application file for complete search history.

(56) References Cited

U.S. PATENT DOCUMENTS

| | | | | | |
|---|---|---|---|---|---|
| 3,775,983 | A * | 12/1973 | Aubert | E02B 7/44 | 405/102 |
| 4,073,147 | A * | 2/1978 | Nomura | E02B 7/44 | 405/100 |
| 5,199,812 | A * | 4/1993 | McClellan | E02B 7/44 | 405/101 |
| 5,310,284 | A * | 5/1994 | Snowberger | E02B 7/44 | 405/102 |
| 8,439,594 | B1 * | 5/2013 | Clark | E01F 13/12 | 256/13.1 |
| 2012/0219360 | A1 * | 8/2012 | Morii | E02B 7/44 | 405/100 |
| 2012/0237297 | A1 * | 9/2012 | Morii | E02B 7/44 | 405/21 |
| 2013/0209173 | A1 * | 8/2013 | Quek | E04H 9/145 | 405/87 |

* cited by examiner

*Primary Examiner* — Carib A Oquendo

(57) ABSTRACT

A water conserving gate includes a base and a gate board configured to resist external water flow. A first supporting column, a second supporting column and a third supporting column are sequentially arranged on an upper portion of the base. A control box is arranged on the upper portion of the base. A first connecting rod is connected between a gate board and the first supporting column; a second connecting rod is connected between the gate board and the second supporting column. A third connecting rod is connected between the gate board and the third supporting column. A first rotary boss arranged on the first supporting column is movably connected with the first connecting rod. A second rotary boss arranged on the second supporting column is movably connected with the second connecting rod.

3 Claims, 4 Drawing Sheets

WATER CONSERVING GATE

BACKGROUND

1. Technical Field

The present disclosure relates to water conserving gate devices technology, and in particular to a water conserving gate with reasonable structural design, high intelligence degree, long service life, high-strength and high crashworthiness.

2. Description of Prior Art

A gate is a control facility used to close and open a water channel, and is used to intercept water flow, control water level, regulate flow, discharge sediment and floats, etc. Sorted by material, there are mainly wooden gates, wooden panel steel structure gates, cast iron gates, reinforced concrete gates, etc. When selecting the gate, it is necessary to select according to a working nature, a setting position, a operating conditions, and a construction cost, etc. At present, the most widely used gates are generally simple in structure, inconvenient to install, low in structural strength, are not designed to be collided against, and are not conducive to long-term use. Further, a degree of intelligence of the gate is not enough and requires more human participation.

Based on the above problems, how to effectively improve the structural performance and intelligence level of the gates, especially the water conserving gates are frequently considered by those skilled in the art. A lot of research, development, and experiments have been carried out, and good results have been obtained.

SUMMARY

In order to overcome the problems existing in the prior art, the present disclosure provides a water conserving gate with reasonable structural design, high intelligence degree, long service life, high-strength and high crashworthiness.

Compared with the prior art, the present disclosure of a water conserving gate comprises a base. A first supporting column, a second supporting column and a third supporting column are sequentially arranged on an upper portion of the base. The base is of a square structure. And the first supporting column, the second supporting column, and the third supporting column are all cuboid. The first supporting column, the second supporting column, the third supporting column and the base are equal in length. A first connecting rod is connected between a gate board and the first supporting column. A second connecting rod is connected between the gate board and the second supporting column. A third connecting rod is connected between the gate board and the third supporting column. In an actual use process, the first connecting rod, the second connecting rod and the third connecting rod are capable of effectively supporting the gate board, and achieving good safety performance. The present disclosure is reasonable in structure design and high in the reliability of use.

DETAILED DESCRIPTION

To make the objects, technical proposals and merits of the present disclosure more apparent, the present disclosure will be further described in detail with reference to the drawings and embodiments. It should be understood that the embodiments described here are only used to illustrate the present disclosure and are not intended to limit the present disclosure.

Figure 1:
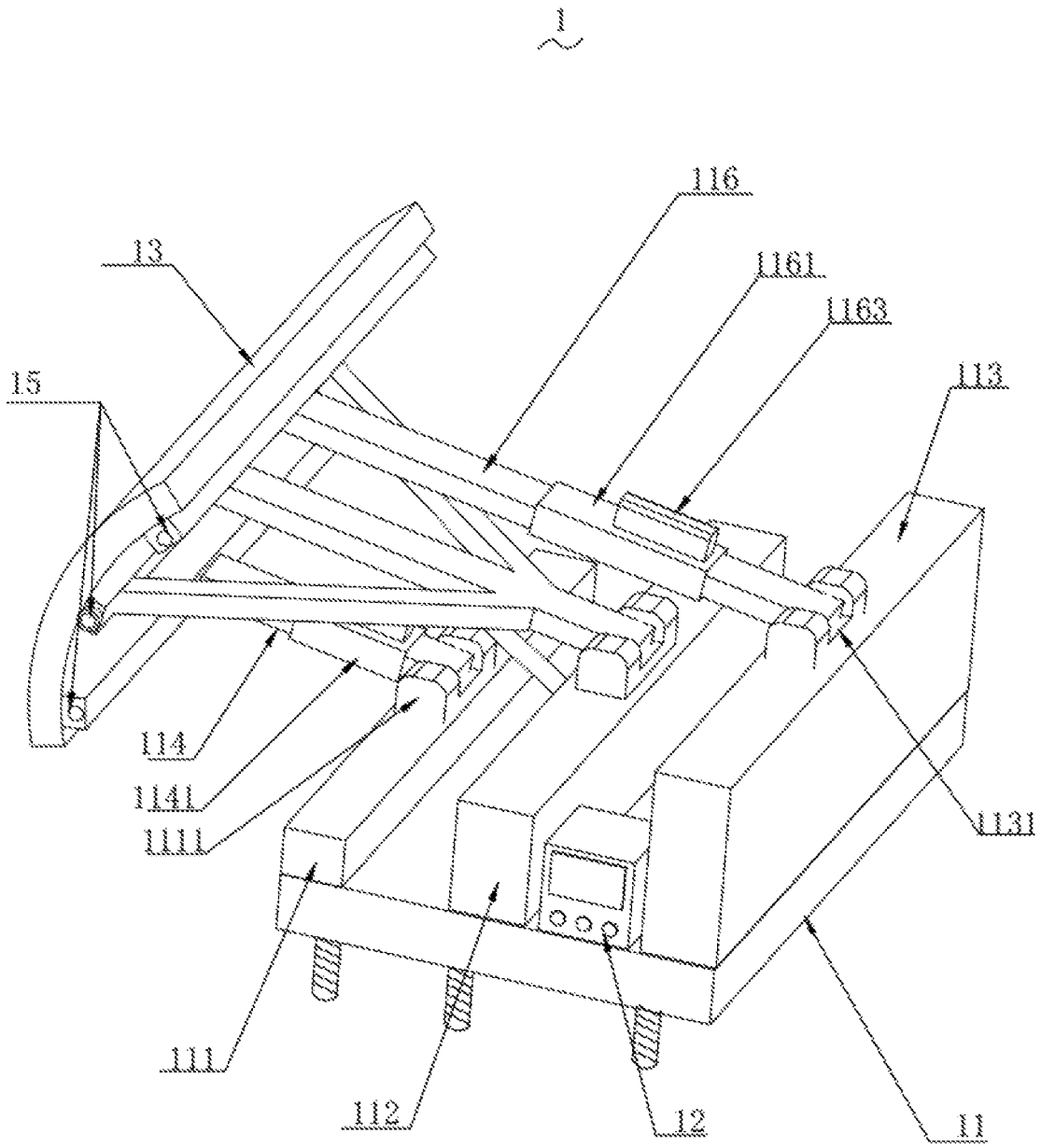
FIG. 1 is a perspective view showing a structure diagram of a water conserving gate of the present disclosure.
Figure 2:
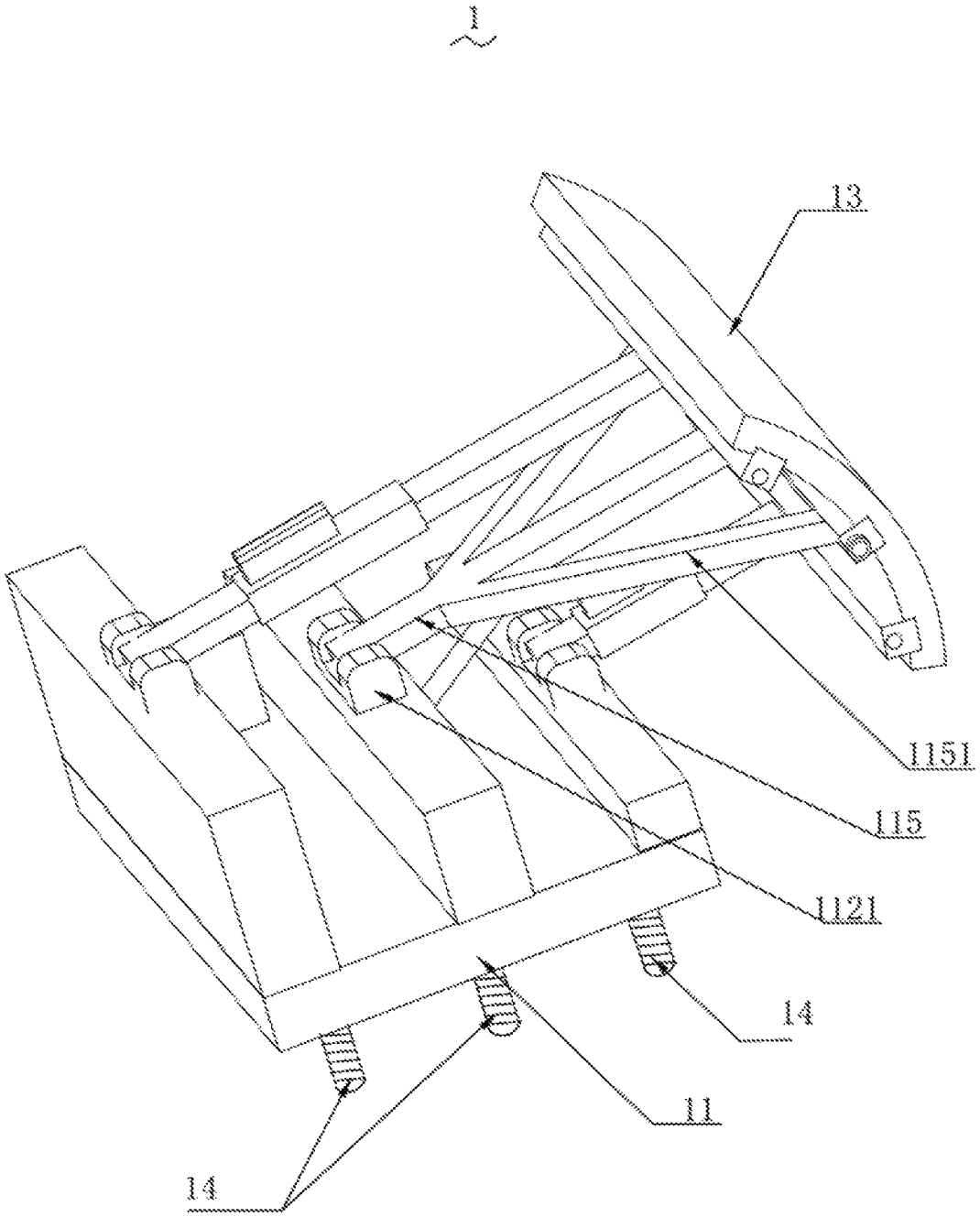
FIG. 2 is another perspective view showing a structure diagram of the water conserving gate of the present disclosure.
Figure 3:
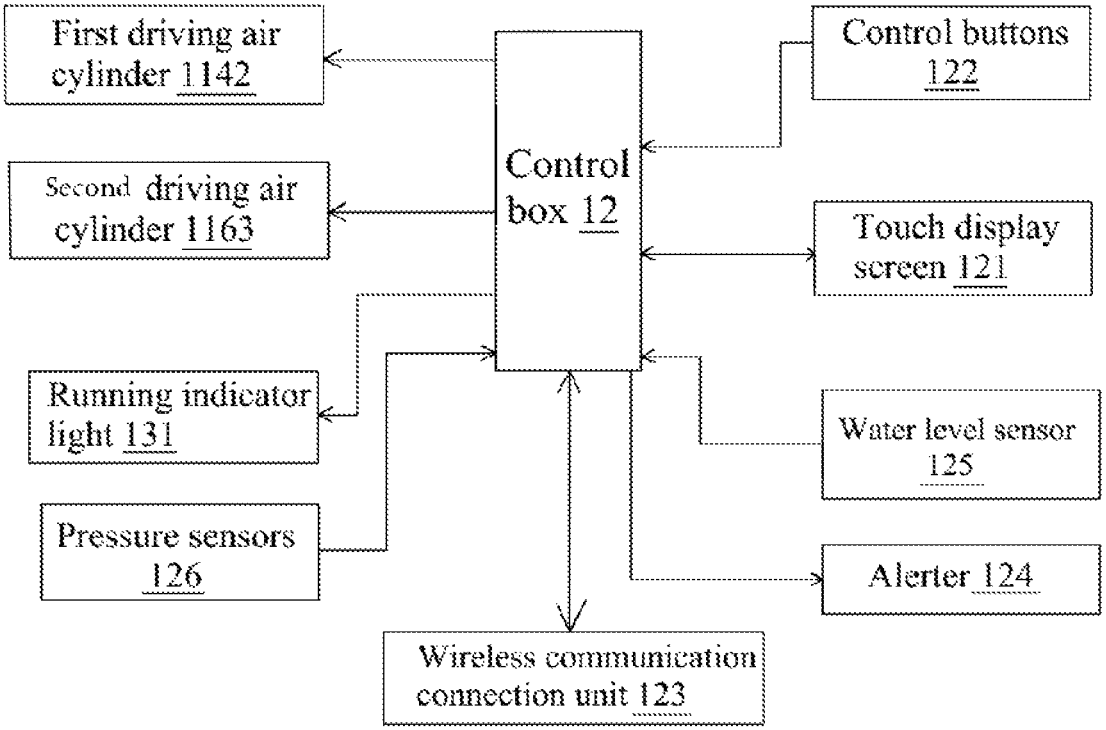
FIG. 3 is a schematic diagram showing a circuit connecting structure of the water conserving gate of the present disclosure.
Figure 4:
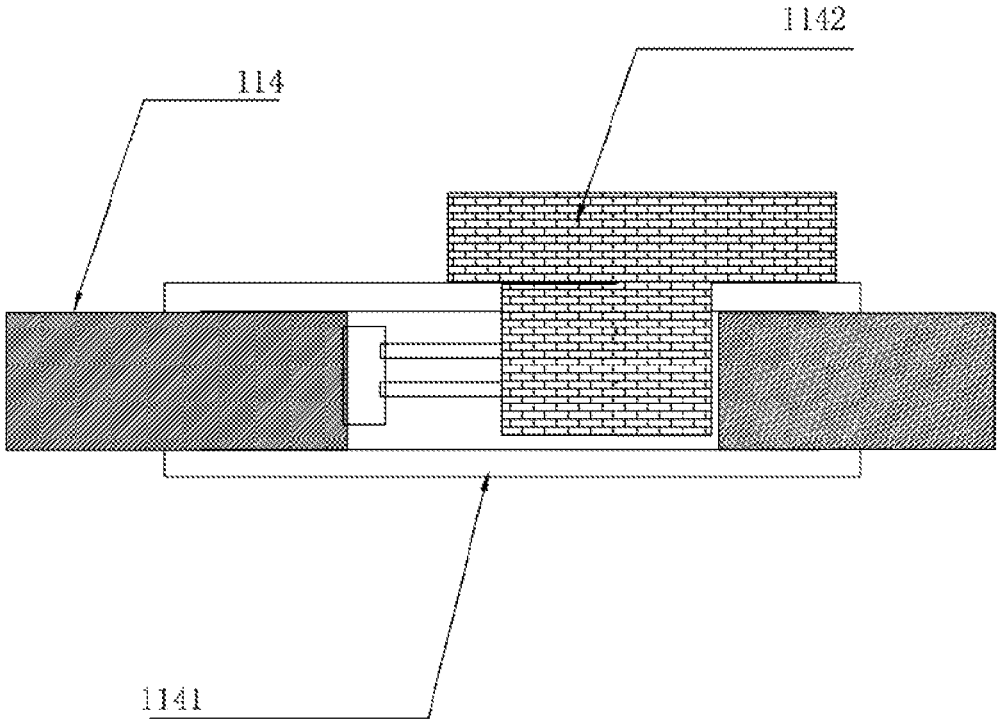
FIG. 4 is a partial cross-sectional view of the water conserving gate of the present disclosure.

As shown in FIG. 1 to FIG. 3, the present disclosure of a water conserving gate 1 with high-strength and high crashworthiness comprises a base 11. A first supporting column 111, a second supporting column 112, and a third supporting column 113 are sequentially arranged on an upper portion of the base 11. The base 11 is of a square structure. And the first supporting column 111, the second supporting column 112, and the third supporting column 113 are all cuboid. The first supporting column 111, the second supporting column 112, the third supporting column 113, and the base 11 are equal in length.

A control box 12 is arranged on an upper portion of the base 11. The water conserving gate 1 further comprises a gate board 13 configured to resist external water flow. A first connecting rod 114 is connected between the gate board 13 and the first supporting column 111. A second connecting rod 115 is connected between the gate board 13 and the second supporting column 112. A third connecting rod 116 is connected between the gate board 13 and the third supporting column 113. A first rotary boss 1111 arranged on the first supporting column 111 is movably connected with the first connecting rod 114. A second rotary boss 1121 arranged on the second supporting column 112 is movably connected with the second connecting rod 115. A third rotary boss 1131 arranged on the third supporting column 113 is movably connected with the third connecting rod 116.

A first length adjusting mechanism 1141 (e.g., a length adjusting rod) is connected to the first connecting rod 114, and a first driving air cylinder 1142 is arranged on an upper portion of the first length adjusting mechanism 1141. A second length adjusting mechanism 1161 (e.g., a length adjusting rod) is connected to the third connecting rod 116, and a second driving air cylinder 1163 is arranged on an upper portion of the second length adjusting mechanism 1161. The first driving air cylinder and the second driving air cylinder 1163 are electrically connected with the control box 12. A touch display screen 121 and a plurality of control buttons 122 are arranged on a front surface of the control box 12.

Rotating shafts 15 are respectively arranged on a connecting portion of the first connecting rod 114 and the gate board 13, a connecting portion of the second connecting rod 115 and the gate board 13, and a connecting portion of the third connecting rod 116 and the gate board 13. The rotating shafts 15 are configured to respectively drive the first connecting rod 114, the second connecting rod 115, and the third connecting rod 116 to rotate relative to the gate board 13. The gate board 13 is bent in an arc shape, and the gate board 13 ranges from 20-30 cm in thickness. A limiting blocks configured to fix the control box 12 is arranged on the base 11. A bottom portion of the control box 12 is engaged with the limiting block.

The water conserving gate 1 further comprises a wireless communication connection unit 123, an alerter 124, a water level sensor 125, and pressure sensors 126. The wireless communication connection unit 123 is configured to communicate with an external mobile terminal. The pressure sensors 126 are respectively arranged on the first rotary boss 1111, the second rotary boss 1121, and the third rotary boss 1131. And the water level sensor 125 is arranged on a front end portion of the gate board 13. A running indicator light 131 is arranged on the front end portion of the gate board 13 to indicate an operation condition of the water conserving gate 1. The wireless communication connection unit 123, the alerter 124, the water level sensor 125, the pressure sensors 126, and the running indicator light 131 are electrically connected with the control box 12. The first supporting column 111, the second supporting column 112, and the third supporting column 113 are sequentially increased in height. The first supporting column 111 ranges from 30-45 cm in height. The second supporting column 112 ranges from 50-65 cm in height. The third supporting column 113 ranges from 75-85 cm in height. A plurality of buffering bosses arranged in a matrix are integrally formed on a front end surface of the gate board 13. The buffering boss is sharp. A plurality of fixing mechanisms 14 (e.g., fixing riles) for fixing the base 11 to an external object are arranged on a lower portion of the base 11. The second connecting rod 115 branches toward two sides to form two reinforcing rods 1151 to improve a supporting strength. An end of each reinforcing rod 1151 is integrally formed with the second connecting rod 115, and an other end of each reinforcing rod 1151 is connected with the gate board 13. Angles between each reinforcing rod 1151 and the second connecting rod 115 are equal.

The present disclosure of the water conserving gate 1 comprises the base 11. The first supporting column 111, the second supporting column 112, and the third supporting column 113 are sequentially arranged on the upper portion of the base 11. The base 11 is of the square structure. And the first supporting column Ill the second supporting column 112, and the third supporting column 113 are all cuboid. The first supporting column 111, the second supporting column 112, the third supporting column 113 and the base 11 are equal in length. The first connecting rod 114 is connected between the gate board 13 and the first supporting column 111. The second connecting rod 115 is connected between the gate board 13 and the second supporting column 112. The third connecting rod 116 is connected between the gate board 13 and the third supporting column 113. In an actual use process, the first connecting rod 114, the second connecting rod 115 and the third connecting rod 116 are capable of effectively supporting the gate board 13, and achieving good safety performance. The present disclosure is reasonable in structure design and high in the reliability of use.

Furthermore, the first rotary boss 1111 is arranged on an intermediate portion of the first supporting column 111. The second rotary boss 1121 is arranged on an intermediate portion of the second supporting column 112. The third rotary boss 1131 is arranged on an intermediate portion of the third supporting column 113.

Furthermore, the touch display screen is a capacitive touch display screen.

Furthermore, a connecting portion of the first rotary boss 1111 and the first connecting rod 111, a connecting portion of the second rotary boss 1121 and the second connecting rod 115, a connecting portion of the third rotary boss 1131 and the third connecting rod 116 respectively have an elastic buffering mechanism.

Compared with the prior art, the present disclosure of the water conserving gate 1 comprises the base 11. The first supporting column 111, the second supporting column 112, and the third supporting column 113 are sequentially arranged on the upper portion of the base 11. The base 11 is of the square structure. And the first supporting column 111 the second supporting column 112, and the third supporting column 113 are all cuboid. The first supporting column 111, the second supporting column 112, the third supporting column 113, and the base 1 are equal in length. The first connecting rod 114 is connected between the gate board 13 and the first supporting column 111. The second connecting rod 115 is connected between the gate board 13 and the second supporting column 112. The third connecting rod 116 is connected between the gate board 13 and the third supporting column 113. In the actual use process, the first connecting rod 114, the second connecting rod 115, and the third connecting rod 116 are capable of effectively supporting the gate board 13, and achieving good safety performance. The present disclosure is reasonable in structure design and high in the reliability of use.

The above-described embodiments of the present disclosure are not to be construed as limiting the scope of the present disclosure. Any of the modifications, equivalent replacement, and improvement within the spirit and principle of the present disclosure should fall within the protection scope of the claims.

What is claimed is:

1. A water conserving gate, comprising:

a base; and a first supporting column, a second supporting column, and a third supporting column sequentially arranged on an upper portion of the base;

wherein the base is of a square structure; the first supporting column, the second supporting column, and the third supporting column are all cuboid; the first supporting column, the second supporting column, the third supporting column, and the base are equal in length;

wherein a control box is arranged on an upper portion of the base; the water conserving gate further comprises a gate board configured to resist external water flow; a first connecting rod is connected between the gate board and the first supporting column; a second connecting rod is connected between the gate board and the second supporting column; a third connecting rod is connected between the gate board and the third supporting column; a first rotary boss arranged on the first supporting column is movably connected with the first connecting rod, a second rotary boss arranged on the second supporting column is movably connected with the second connecting rod; a third rotary boss arranged on the third supporting column is movably connected with the third connecting rod;

wherein a first length adjusting mechanism is connected to the first connecting rod, and a first driving air cylinder is arranged on an upper portion of the first length adjusting mechanism; a second length adjusting mechanism is connected to the third connecting rod, and a second driving air cylinder is arranged on an upper portion of the second length adjusting mechanism; the first driving air cylinder and the second driving air cylinder are electrically connected with the control box; a touch display screen and a plurality of control buttons are arranged on a front surface of the control box;

wherein rotating shafts are respectively arranged on a connecting portion of the first connecting rod and the gate board, a connecting portion of the second connecting rod and the gate board, and a connecting portion of the third connecting rod and the gate board; the rotating shafts are configured to respectively drive the first connecting rod, the second connecting rod, and the third connecting rod to rotate relative to the gate board: the gate board is bent in an arc shape, and the gate board ranges from 20-30 cm in thickness; a limiting block configured to fix the control box is arranged on the base; a bottom portion of the control box is engaged with the limiting block;

wherein the water conserving gate further comprising a wireless communication connection unit, an alerter, a water level sensor, and pressure sensors; the wireless communication connection unit is configured to communicate with an external mobile terminal; the pressure sensors are respectively arranged on the first rotary boss, the second rotary boss and the third rotary boss; and the water level sensor is arranged on a front end portion of the gate board, a running indicator light is arranged on the front end portion of the gate board to indicate an operation condition of the water conserving gate; the wireless communication connection unit, the alerter, the water level sensor, the pressure sensors, and the running indicator light are electrically connected with the control box; the first supporting column, the second supporting column and the third supporting column are sequentially increased in height; and the first supporting column ranges from 30-45 cm in height, the second supporting column ranges from 50-65 cm in height; the third supporting column ranges from 75-85 cm in height; a plurality of buffering bosses arranged in a matrix are integrally formed on a front end surface of the gate board; the buffering boss is sharp; a plurality of fixing mechanisms for fixing the base to an external object are arranged on a lower portion of the base; the second connecting rod branches toward two sides to form two reinforcing rods to improve a supporting strength; an end of each reinforcing rod is integrally formed with the second connecting rod, and an other end of each reinforcing rod is connected with the gate board; angles between each reinforcing rod and the second connecting rod are equal.

2. The water conserving gate according to claim 1, wherein the first rotary boss is arranged on an intermediate portion of the first supporting column; the second rotary boss is arranged on an intermediate portion of the second supporting column: the third rotary boss is arranged on an intermediate portion of the third supporting column.

3. The water conserving gate according to claim 1, wherein the touch display screen is a capacitive touch display screen.

* * * * *